US009429121B2

(12) United States Patent
Fischer et al.

(10) Patent No.: US 9,429,121 B2
(45) Date of Patent: Aug. 30, 2016

(54) SYSTEM HAVING A FUEL DISTRIBUTOR AND A HOLDER

(71) Applicant: Robert Bosch GmbH, Stuttgart (DE)

(72) Inventors: Michael Fischer, Niefern-Oeschelbronn (DE); Andreas Rehwald, Bietigheim-Bissingen (DE); Matthias Maess, Boeblingen (DE); Venkatesh Kannan, Novi, MI (US)

(73) Assignee: ROBERT BOSCH GMBH, Stuttgart (DE)

( * ) Notice: Subject to any disclaimer, the term of this patent is extended or adjusted under 35 U.S.C. 154(b) by 128 days.

(21) Appl. No.: 14/396,575

(22) PCT Filed: Apr. 2, 2013

(86) PCT No.: PCT/EP2013/056858
§ 371 (c)(1),
(2) Date: Oct. 23, 2014

(87) PCT Pub. No.: WO2013/160069
PCT Pub. Date: Oct. 31, 2013

(65) Prior Publication Data

US 2015/0075495 A1 Mar. 19, 2015

(30) Foreign Application Priority Data

Apr. 26, 2012 (DE) ..... 10 2012 206 937

(51) Int. Cl.
*F02M 69/46* (2006.01)
*F02M 55/00* (2006.01)
(Continued)

(52) U.S. Cl.
CPC ..... *F02M 55/005* (2013.01); *F02M 55/025* (2013.01); *F02M 61/14* (2013.01); *F02M 69/465* (2013.01); *F02M 2200/09* (2013.01); *F02M 2200/857* (2013.01); *F02M 2200/9015* (2013.01)

(58) Field of Classification Search
CPC ..... F02M 61/14; F02M 69/465; F02M 2200/853; F02M 2200/856; F02M 2200/9015
USPC ..... 123/456, 468–470
See application file for complete search history.

(56) References Cited

U.S. PATENT DOCUMENTS 6,318,329 B1 * 11/2001 Sato ..... F02B 61/045 123/192.1
2006/0162697 A1 * 7/2006 Stieler ..... B29C 65/3656 123/456

(Continued)

FOREIGN PATENT DOCUMENTS

DE 10 2005 009 740 9/2006
DE 10 2008 044 165 6/2010

(Continued)

OTHER PUBLICATIONS

International Search Report for PCT/EP2013/056858, dated Jul. 17, 2013.

*Primary Examiner* — Erick Solis
(74) *Attorney, Agent, or Firm* — Norton Rose Fulbright US LLP

(57) ABSTRACT

A fuel injection system for high-pressure injection in internal combustion engines includes: a fuel distributor; and at least one holder which is used for fastening the fuel distributor to an add-on structure. The holder includes a holder body which has a first layer, a second layer, and an elastically deformable damping layer. The first layer and the second layer are made from a metallic material. The elastically deformable damping layer is disposed between the first layer and the second layer. The holder body is connected to the fuel distributor by laser welding. The damping layer is made of a visco-elastic material.

10 Claims, 4 Drawing Sheets

(51) Int. Cl.
*F02M 55/02* (2006.01)
*F02M 61/14* (2006.01)

(56) References Cited

U.S. PATENT DOCUMENTS

2010/0242916 A1* 9/2010 Hunt ..... F02M 55/025 123/469
2013/0104852 A1* 5/2013 Kannan ..... F02M 61/168 123/456
2013/0125864 A1* 5/2013 Kannan ..... F02M 61/168 123/469
2013/0284152 A1* 10/2013 Fischer ..... F02M 55/025 123/470
2015/0090229 A1* 4/2015 Lang ..... F02M 55/025 123/470
2015/0204295 A1* 7/2015 Wiedmann ..... F02M 55/025 123/456

FOREIGN PATENT DOCUMENTS

DE 10 2009 014 399 8/2010
EP 2 034 172 3/2009
EP 2 236 808 10/2010
WO WO 2008 064970 6/2008

* cited by examiner

SYSTEM HAVING A FUEL DISTRIBUTOR AND A HOLDER

BACKGROUND OF THE INVENTION

1. Field of the Invention

The present invention generally relates to a system that has a fuel distributor and a holder, which is used to fasten the fuel distributor to an add-on structure, especially of an internal combustion engine, and particularly relates to the field of fuel injection systems for the high-pressure injection in internal combustion engines.

2. Description of the Related Art

One fuel-injection device is known from published German patent application document DE 10 2005 009 740 A1. The known fuel-injection device is characterized by a sound-decoupling design. In this particular case, a fuel distributor line is fastened to a cylinder head of an internal combustion engine with the aid of connecting means. At least one damping disk is provided in the region of the connecting means. Such damping disks may be situated in the area below a screw head of the connection means, with seating directly on the fuel distributor line or with seating directly on the cylinder head, so that the high-pressure injection system, made up of the fuel distributor line and a plurality of fuel injection valves, is even more effectively decoupled from the cylinder head and has better sound-insulation.

The fuel-injection device known from published German patent application document DE 10 2005 009 740 A1 has the disadvantage that considerable loading of the damping disks can arise in the region where the fuel distributor line is fastened to the cylinder head, via a tightening torque of the connecting means, which leads to premature fatigue over the course of the service life. A tightening torque that is too weak, on the other hand, may result in insufficient damping and premature wear due to the resulting movement play, especially in the mounting region.

BRIEF SUMMARY OF THE INVENTION

The system according to the present invention has the advantage of ensuring improved vibrational damping over the service life. More specifically, it provides the advantage of ensuring sufficient noise damping even after an extended operating period.

The system allows the fuel distributor to be fastened to an add-on structure, especially of an internal combustion engine. The add-on structure or the internal combustion engine is not necessarily part of the system, and the system can be produced and sold separately from such an add-on structure or internal combustion engine. The system is especially suitable for air compressing, self-igniting internal combustion engines, in which multiple high-pressure fuel injectors carry out the fuel injection. The fuel distributor is connected to the fuel injectors in a suitable manner. At the same time, the fuel distributor may advantageously serve as fuel reservoir, which stores a certain quantity of fuel under high pressure. For this purpose, the fuel is first compressed by a high-pressure pump and then conveyed in controlled quantities into the fuel distributor via a high-pressure line.

Such an approach basically has the inherent problem that the fuel distributor may be incited to vibrations in the audible frequency range. This mainly happens because of noise sources in the high-pressure fuel injectors. In this context it is disadvantageous if the structure-borne noise spreads from the high pressure injectors, for example via fuel rail cups, the fuel distributor and the holder, to the add-on structure, from where interfering noise is radiated, which may even penetrate into the interior of the vehicle under certain circumstances. The add-on structure usually is the cylinder head of an internal combustion engine. However, an application of spacer sleeves or further connecting elements is possible as well.

The development of the holder according to the invention ensures a vibrational decoupling and damping between the fuel distributor and the add-on structure, while complying with the other requirements. The holder may advantageously be developed as a laminated panel of metal layers and one or more elastically deformable damping layer(s) or it may include such a laminated panel.

It is therefore advantageously possible to develop the holder as a sheet-type holder. The vibrational decoupling results from the composite structure made up of the first layer, the elastically deformable damping layer and the second layer. The first layer, the damping layer and the second layer may advantageously be integrally joined to each other.

The holder body is able to be connected to the add-on structure, especially a cylinder head, in a suitable manner. Fastening means, especially screws, may be used for this purpose. Toward this end, suitable screwing points are provided on the holder, which, for example, are implemented as bore holes in the holder.

The holder body enables a decoupling and an isolation of the noise sources and vibrations at the fuel distributor in relation to the add-on structure. These two effects reduce the noise emission and noise transmission from the fuel distributor to the engine.

A mechanical operating principle for reducing vibrations may be realized in an advantageous manner. The damping layer may be laminated between the first layer and the second layer. The damping layer may preferably be developed as a thin damping layer. It is furthermore advantageous that the damping layer is made from a visco-elastic material. The damping layer may be developed as an elastomer layer, in particular. In a relative movement of the first layer and the second layer, the interspaced elastically deformable damping layer is dynamically stressed to a considerable degree, so that a high portion of the vibration energy is dissipated by the material damping of the material of the elastically deformable damping layer. The dissipation of structure-borne noise energy thus results damping of vibration forms of the fuel distributor and in a reduction in further structure-borne noise components that could be transmitted from the fuel distributor into the add-on structure by way of the holder. This decouples and isolates the fuel distributor from the add-on structure.

The characteristics of the elastically deformable damping layer are adjustable via the thickness and the material properties of the material for the damping layer. Possible parameters for this purpose are the frequency contents to be damped and the ambient and operating temperatures. Conceivable is also a multilayer development of multiple layers, which are at least essentially formed from a metallic material in each case, and elastically deformable damping layers disposed in-between. It is also possible to use different metallic materials. Specifically, the elastically deformable damping layer or layers may be produced from a visco-elastic material.

Since the decoupling is essentially realizable via the design of the holder, a high degree of freedom is provided in developing the fuel distributor or the add-on structure. This allows for a broad range of applications.

Several options exist for developing the holder. In one preferred development, the holder is made up of precisely two metallic layers and precisely one elastically deformable damping layer, which is situated between the metallic layers.

According to another potential development, more than two metallic layers are provided, especially three metallic layers. A separate elastically deformable damping layer is then situated between these metallic layers. Thus, at least two elastically deformable damping layers are provided.

In addition to the metallic layers and the elastically deformable damping layer or layers, the holder could also include further parts. In particular, it is possible to provide a suitable coating to protect the holder from the environment.

The holder body is connected to the fuel distributor by welding. Several developments are possible for this joining concept. In contrast to soldering, the development of one or more welding joints makes it possible to ensure that the elastically deformable damping layer will not be destroyed by temperature influences. The use of laser welding in particular avoids the introduction of heat into the elastically deformable damping layer or possibly also prevents it entirely. Welding seams, especially laser seams, may be produced directly in the region of the contact points. A local worsening of the properties of the damping layer due to the temperature effect during the welding may be accepted in the individual case. However, to avoid the escape of liquefied material that forms the elastically deformable damping layer under the action of high temperatures, an advantageous development is possible, in which the elastically deformable damping layer in the joining region is already removed prior to the welding in the region of the welding location, or in which this region is left free from the outset. This makes it possible to avoid splatters or gases that occur in the escape of liquefied or thermally damaged material. In the removal of one or more elastomer layer(s), one or more of the metallic layer(s) is/are preferably removed in the joining region. The removal may be done by a separation in the composite structure, using a bending and/or stamping step. Depending on the application case, the holder may also receive follow-up treatment in the connection region, such as cleaning, in particular, in order to prevent that leftover material of the elastically deformable damping layer remains behind in the connection region.

It is therefore advantageous that the holder body is connected to the fuel distributor by laser welding. It is furthermore advantageous that an outer side of the holder body facing the fuel distributor is developed at the first layer, at least in a connection area of the welding connection between the holder body and the fuel distributor, and that the first layer of the holder body is connected to the fuel distributor by welding, especially laser welding. According to one advantageous development, the elastically deformable damping layer and the second layer are omitted in the connection area. Liquefaction or evaporation of the material of the damping layer during the connection by welding is thereby preventable from the outset. The process safety is therefore improved as well.

The first layer of the holder body is advantageously developed as an externally situated first layer. In one potential development, the second layer of the holder body is likewise produced as an externally situated second layer. The first layer and the second layer therefore constitute the outer sides of the holder body that face away from one another.

In another potential development, it is advantageous that the holder body has at least one third layer, which is at least essentially made from a metallic material and has at least one further elastically deformable damping layer; that the second layer of the holder body is developed as an internally situated second layer; and that the further elastically deformable damping layer is disposed between the internally situated second layer and the third layer. In this development it is therefore possible to provide multiple damping layers as a composite structure.

The metallic layers may be made of the same metallic material, but a development that uses different metallic materials or only partially the same metallic materials is possible as well. The elastically deformable damping layers can advantageously be made from the same material as well, especially a visco-elastic material. However, it is also possible to use different materials for the elastically deformable damping layers.

Rubber may advantageously be used as visco-elastic material for the damping layer. The term rubber should be taken quite generally in this case, and besides synthetic rubber materials also includes natural rubber. Furthermore, polymers are usable as material for the damping layer. Thermoplastic elastomers, in particular, are suitable as polymers. However, a pure thermoplastic may be used as polymer as well, which, however, exhibits poorer damping behavior but better durability or resistivity. Depending on the application case, a combination of these materials may be advantageous as well. For example, this could be achieved by a development that includes multiple damping layers.

In an advantageous manner, the holder body is at least approximately developed in strip form. The holder body may be joined to the add-on structure by a one-sided screw connection. In this development, the system preferably has multiple holders of this type in order to ensure a stable fastening of the fuel distributor to the add-on structure. In addition, a bilateral screw connection of the holder body is possible, in which, for instance, the holder body extends across the fuel distributor, so that the fuel distributor is situated between two fastening means provided for the holder body, especially screws, in the installed state. In this development as well, it is advantageous that the system includes multiple holders of this type. A combination of unilaterally screw-fitted holders and bilaterally screw-fitted holders is possible as well.

It is also advantageous that the fuel distributor is developed as a fuel distributor rail, that the holder body is connected to the fuel distributor along a longitudinal axis of the fuel distributor, and that securing tabs are developed on the holder body, via which the holder body is able to be fastened to the add-on structure. This makes it possible to realize a holder body which is developed as bridge holder, in particular. A screw point can be realized on each securing tab. Depending on the application case, the number of securing tabs may also be greater than the number of securing tabs required for the fastening. This allows a development for different screw patterns.

It is also advantageous that, at least in a connection region of the welding joint between the holder body and the fuel distributor, the fuel distributor has an outer side that is not planar and that the holder body is premolded on the non-planar outer side of the fuel distributor at least in the connection area. This makes it possible to achieve a partially premolded design of the holder with respect to the outer side of the fuel distributor, in order to provide a larger contact surface. In this case, the length of the enclosing welding seam is able to be extended as well, and better form stability of the system is achievable.

In combination with the direct welding of the holder(s) to the holder body, it is therefore possible to realize a number of advantages in the system that may have a single or multiple holder(s), depending on the development.

The noise transmission from the fuel distributor, especially a fuel distributor rail, into the add-on structure, especially the internal combustion engine, is reduced.

Vibrations of the fuel distributor are able to be damped more strongly, which reduces the sound radiation from the outer side of the fuel distributor.

The vibrational stressing of the fuel distributor and of the high-pressure fuel injectors as a result of the vibration stressing of the internal combustion engine can be reduced, since the transmission of vibrations is damped in this direction as well. This also creates advantages with regard to the design and the reliability of these components.

The design of the system requires no additional parts. Above all, the holder may be screwed directly into the cylinder head and, in contrast to the use of elastomeric isolators of a solid material, requires no pretension restriction that restricts the pretensioning of the elastomeric isolator.

Because of the vulcanization possibility during the production of the composite system, the damping layer may be highly resistant and be protected against abrasion. Loads are distributed across large surfaces due to the planar design of the damping layer, while a high damping effect is achieved at the same time.

In addition, the holder may be shaped as desired within certain limits. This allows an adaptation to different geometrical requirements.

It is furthermore possible to retain fastening and service concepts in the production or in a workshop without any, or only negligible, adaptations.

DETAILED DESCRIPTION OF THE INVENTION

Figure 1:
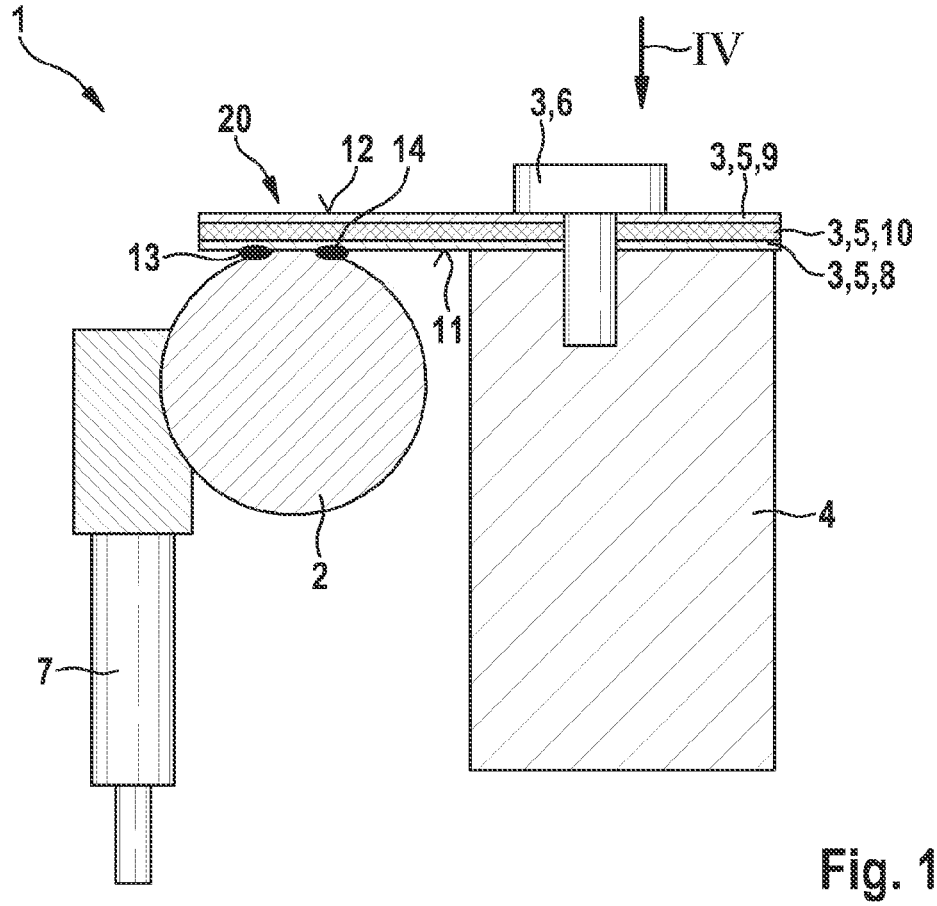
FIG. 1 shows a system having a fuel distributor and a holder, which is used to fasten the fuel distributor to an add-on structure, and a fuel injector which is connected to the fuel distributor, in an excerpted, schematic sectional representation corresponding to a first exemplary embodiment of the present invention.

FIG. 1 shows a system 1 having a fuel distributor 2 and at least one holder 3, which is used to fasten the fuel distributor 2 to an add-on structure 4, in an excerpted, schematic sectional representation corresponding to a first exemplary embodiment.

System 1 may particularly be designed as a fuel-injection system 1 for an injection under high pressure in internal combustion engines. Add-on structure 4 may be an internal combustion engine 4, especially a cylinder head 4 of an internal combustion engine 4.

In this exemplary embodiment, holder 3 has a holder body 5 and a fastening means 6. Fastening means 6 may in particular be embodied as a screw 6. Fuel distributor 2 is fixed in position with respect to add-on structure 4 via holder 3. In the process, fuel injectors 7 that are connected to fuel distributor 2, especially high-pressure fuel injectors 7, are able to be fixed in place as well.

In this exemplary embodiment, holder body 5 has a first layer 8, which is made of a metallic material, a second layer 9, which is likewise made of a metallic material, and an elastically deformable damping layer 10. Elastically deformable damping layer 10 is preferably made from a viscoelastic material. In this exemplary embodiment, an outer side 11 of holder body 5 facing fuel distributor 2 is provided at first layer 8. An outer side 12 of holder body 5 facing away from outer side 11 is developed at second layer 9. In this exemplary embodiment, first layer 8 thus is developed as externally situated first layer 8. Second layer 9 is developed as externally situated second layer 9. Situated between the two layers 8, 9 is damping layer 10. Damping layer 10 is an internally situated damping layer 10. Damping layer 10 is preferably integrally connected to metallic layers 8, 9. The connection of damping layer 10 to layers 8, 9 may be produced by vulcanization, for example. Holder body 5 is therefore developed as a composite construction of metallic layers 8, 9 and damping layer 10.

Holder body 5 of holder 3 is connected to fuel distributor 2 by welding. Laser welding is preferably used for this purpose. In this exemplary embodiment, holder 3 is connected to fuel distributor 2 by means of two welding seams 13, 14 implemented by laser welding. Depending on the development, it is possible to provide welding seams 15, 16 in lateral contact regions as well, as illustrated with the aid of FIG. 4.

Local heating of holder body 5 occurs in a connection area 20, in which holder body 5 is connected to fuel distributor 2 by laser welding. This may cause local changes in the characteristics of damping layer 10 in this exemplary embodiment. Holder body 5 is preferably welded to fuel distributor 2 in such a way that first layer 8 of holder body 5 is connected to fuel distributor 2 by welding, welding seams 13, 14 forming only with respect to first layer 8.

In this exemplary embodiment, outer side 11 of holder body 5 facing fuel distributor 2 is developed on first layer 8, especially in connection region 20 of the welding connection between holder body 5 and fuel distributor 2. Outside of connection area 20, outer side 11 may possibly also be formed on a protective layer or the like.

Figure 2:
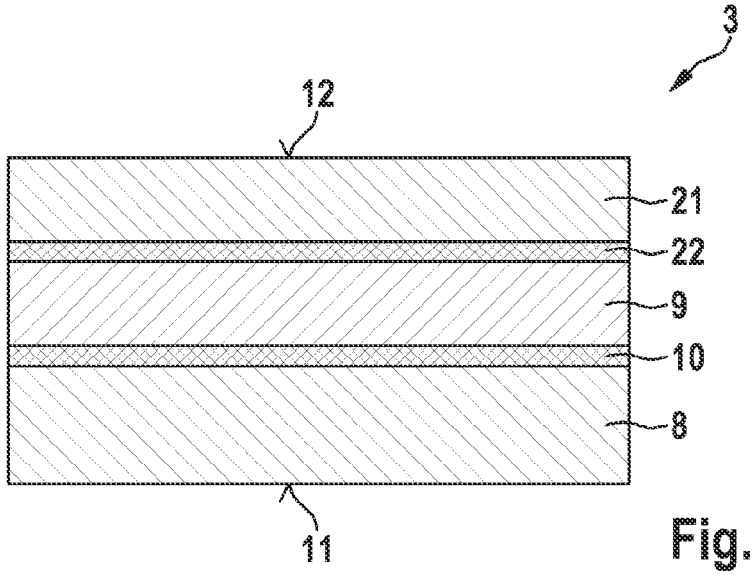
FIG. 2 shows a holder of the system shown in FIG. 1, in an excerpted, schematic sectional view, corresponding to a second exemplary embodiment of the present invention.

FIG. 2 shows a holder 3 of system 1 shown in FIG. 1, in an excerpted, schematic sectional view, corresponding to a second exemplary embodiment. In this exemplary embodiment, holder body 5 has a third layer 21, which is made of a metallic material, and an additional elastically deformable damping layer 22. Second layer 9 is developed as internally situated second layer 9 in this exemplary embodiment. The further elastically deformable damping layer 22 is disposed between internally situated second layer 9 and third layer 21. Outer side 12 of holder body 5 is developed on third layer 21. Third layer 21 is developed as externally situated third layer 21. The further elastically deformable damping layer 22 is preferably integrally connected to second layer 9 and third layer 21. This advantageously forms a composite construction of metallic layers 8, 9, 21 and damping layers 10, 22.

In a corresponding manner, it is also possible to form a composite construction of more than three metallic layers 8, 9, 21 and more than two damping layers 10, 22.

Figure 3:
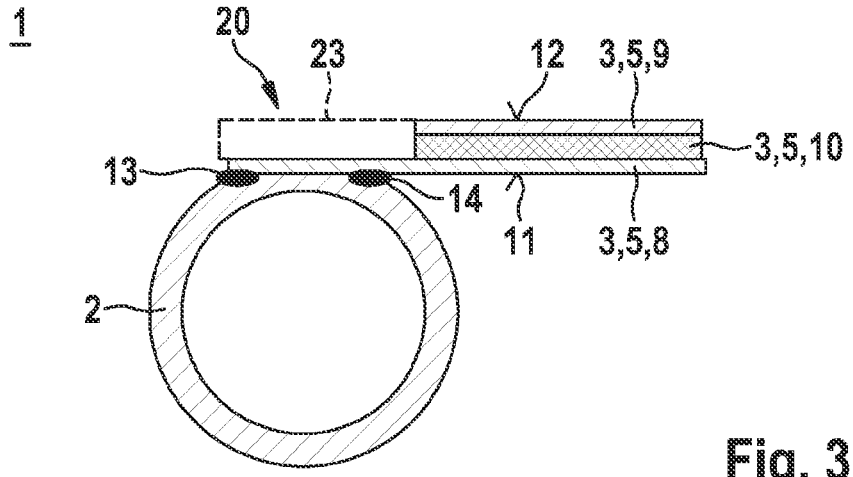
FIG. 3 shows a holder and a fuel distributor of the system shown in FIG. 1, in an excerpted, schematic sectional view, corresponding to a third exemplary embodiment of the present invention.

FIG. 3 shows system 1 shown in FIG. 1 with a holder 3 and a fuel distributor 2, in an excerpted, schematic sectional representation corresponding to a third exemplary embodiment. In this exemplary embodiment, elastically deformable damping layer 10 and second layer 9 are omitted in connection region 20. This creates a recess 23 in holder body 5, which is illustrated by the broken line. The connection of holder 3 to fuel distributor 2 is implemented by welding first layer 8 of holder body 5 to fuel distributor 2 in connection region 20. Local heating of first layer 8 occurs as a result. Since damping layer 10 is omitted in connection region 20, liquefaction of damping layer 10 is prevented from the outset. This also prevents the production of splatters or vapors, which improves the production process. The process safety is improved as well.

Figure 4:
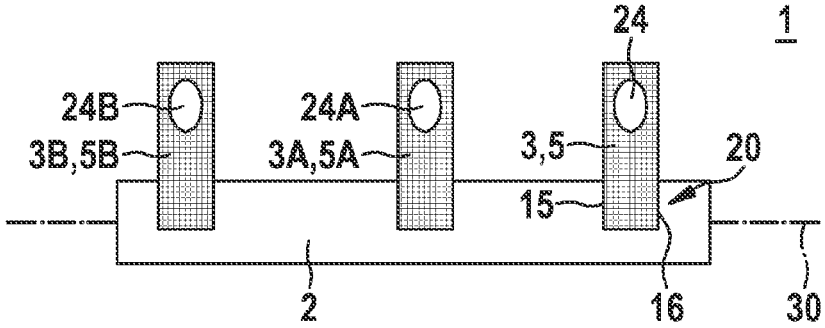
FIG. 4 shows the system shown in FIG. 1, in a schematic view, corresponding to a fourth exemplary embodiment of the present invention.

FIG. 4 shows system 1 shown in FIG. 1, as seen from a viewing direction designated by IV, in a schematic view corresponding to a fourth exemplary embodiment. In this exemplary embodiment, holder body 5 of holder 3 is developed in strip form. Holder body 5 has a through hole 24, through which fastening means 6, especially screw 6, is guided for the fastening to add-on structure 4. This defines a one-sided fastening to holder 3, especially a one-sided screw joint.

This development preferably provides additional holders 3A, 3B, which are developed according to holder 3. Holder body 5A, 5B of holders 3A, 3B likewise have through holes 24A, 24B so as to allow fastening to add-on structure 4 with the aid of suitable fastening means. In this exemplary embodiment, further holders 3A, 3B are likewise provided with strip-shaped holder bodies 5A, 5B.

Figure 5:
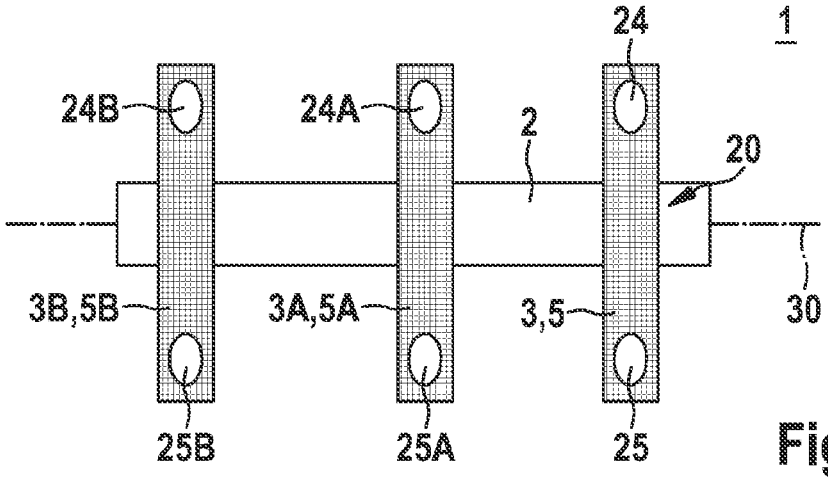
FIG. 5 shows the system shown in FIG. 4, in a schematic view, corresponding to a fifth exemplary embodiment of the present invention.

FIG. 5 shows system 1 shown in FIG. 4, in a schematic representation, corresponding to a fifth exemplary embodiment. In this exemplary embodiment, holder body 5 of holder 3 has through hole 24 for one, and a through hole 25 for another. The connection between holder body 5 and fuel distributor 2 takes place between through holes 24, 25 in this case. This allows a bilateral fastening, especially a bilateral screw fitting, of holder 3 to add-on structure 4. Additional holders 3A, 3B are preferably provided in this development. These holders 3A, 3B may have a similar design as holder 3 shown in FIG. 5. In this development, holder body 5A has through holes 24A, 25A. Holder body 5B of holder 3B is provided with through holes 24B, 25B.

However, system 1 can also have holders of a different design. A combination of holders screw-fitted or screw-fittable on one side and holders that are screw-fitted, or screw-fittable, on both sides is possible as well.

In particular, fuel distributor 2 may be embodied in the form of a fuel distributor rail 2 having a longitudinal axis 30. In this case, holder bodies 5, 5A, 5B are preferably oriented perpendicularly to longitudinal axis 30 in the projection.

Figure 6:
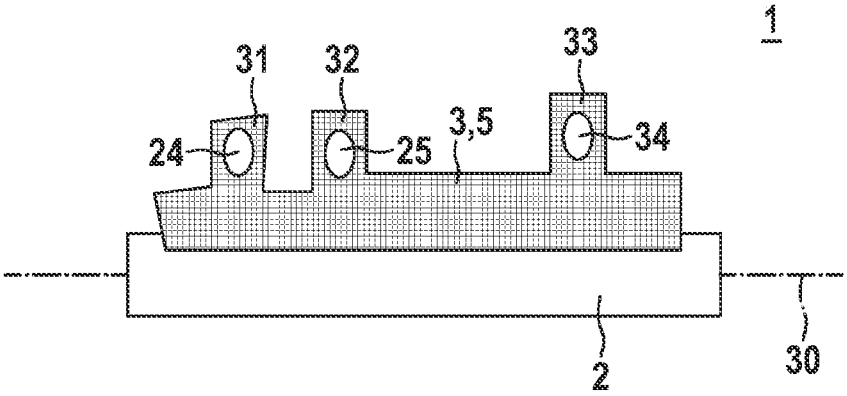
FIG. 6 shows the system shown in FIG. 4, in a schematic view, corresponding to a sixth exemplary embodiment of the present invention.

FIG. 6 shows system 1 shown in FIG. 4, in a schematic representation, corresponding to a sixth exemplary embodiment. In this exemplary embodiment, fuel distributor 2 is developed as fuel distributor rail 2 having a longitudinal axis 30. Holder body 5 of holder 3 is connected to fuel distributor 2 along longitudinal axis 30 of fuel distributor 2. Furthermore, securing tabs 31, 32, 33 are developed on holder body 5, via which holder body 5 is able to be fastened on add-on structure 4. Securing tabs 31 through 33 are provided with through holes 24, 25, 34 for the fastening. Precisely one through hole 24, 25, 34 is provided on each securing tab 31 through 33 in this exemplary embodiment.

As a result, the composite construction of metallic layers 8, 9 and damping layer 10 is able to be developed in a suitable manner. In the process, a simple adaptation to different screw patterns is able to be made by appropriate cutting.

Figure 7:
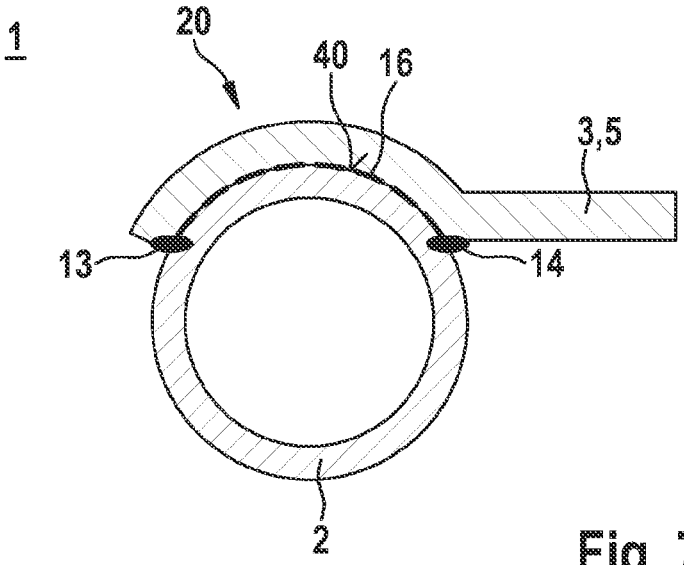
FIG. 7 shows the system shown in FIG. 3, in an excerpted, schematic sectional view, corresponding to a seventh exemplary embodiment of the present invention.

FIG. 7 shows system 1 shown in FIG. 3 with a holder 3 and a fuel distributor 2, in an excerpted, schematic sectional representation corresponding to a seventh exemplary embodiment. Fuel distributor 2 has an outer side 4, which, among others, does not have a planar design in connection region 20. In this exemplary embodiment, outer side 40 is developed in the form of a cylinder sleeve segment in connection region 20. Holder body 5 is premolded on arched outer side 40 of fuel distributor 2 in connection region 20. This creates a larger contact surface between holder body 5 and fuel distributor 2. This also enhances the option of developing a lateral welding seam 16. In this exemplary embodiment, welding seam 16 is therefore able to be developed in the form of a circular line, while ensuring a connection between holder body 5 and fuel distributor 2 across the entire length.

Figure 8:
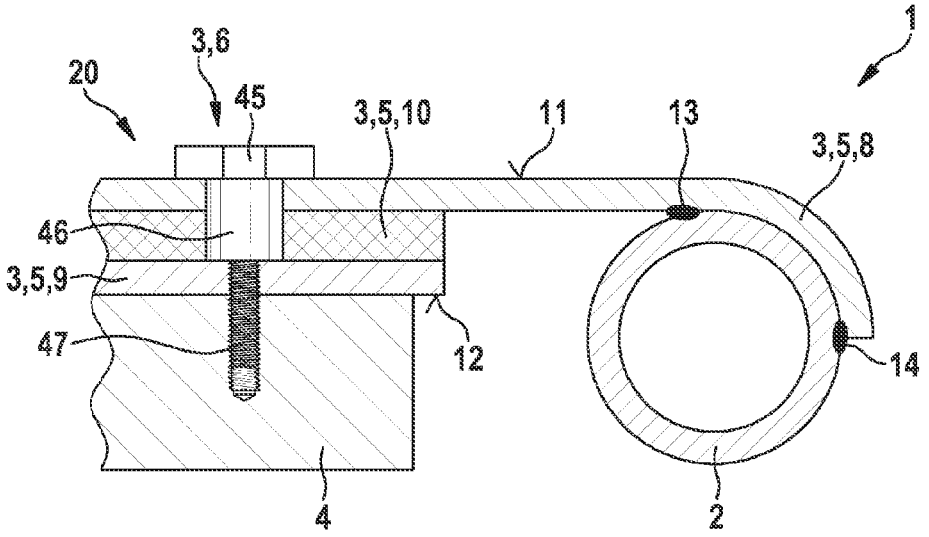
FIG. 8 shows the system shown in FIG. 3, in an excerpted, schematic sectional view, corresponding to an eighth exemplary embodiment of the present invention.

FIG. 8 shows system 1 shown in FIG. 3, in an excerpted, schematic sectional view, corresponding to an eighth exemplary embodiment. In this exemplary embodiment, second layer 9 is facing add-on structure 4. Furthermore, second layer 9 is omitted in the region of fuel distributor 2. In the same way, damping layer 9 is also omitted in the region of fuel distributor 2. Welding seams 13, 14 join first layer 8 to fuel distributor 2.

The fastening has the advantage that fuel distributor 2 is connected to layer 8, which does not lie right next to add-on structure 4. For layer 8 is separated from layer 9 which is resting against add-on structure 4 by damping layer 10. This further improves the vibration damping.

Moreover, fastening means 6 is developed as a collar screw 6. The collar screw has a head 45, a collar 46, and a threaded bolt 47. The threaded bolt is screwed into add-on structure 4. The pretension that is acting on damping layer 10 is restricted and specified in a defined manner by a height of collar 46. In addition, collar 46 rests against layer 9, which is braced on add-on structure 4. As a result, it is possible to achieve a high fastening force with respect to layer 9, which may be considerably higher than the prestress force acting on damping layer 10.

In a variation, collar 46 may also rest directly against the add-on structure. The fastening force and the prestress force acting on damping layer 10 are then of equal magnitude, however.

Figure 9:
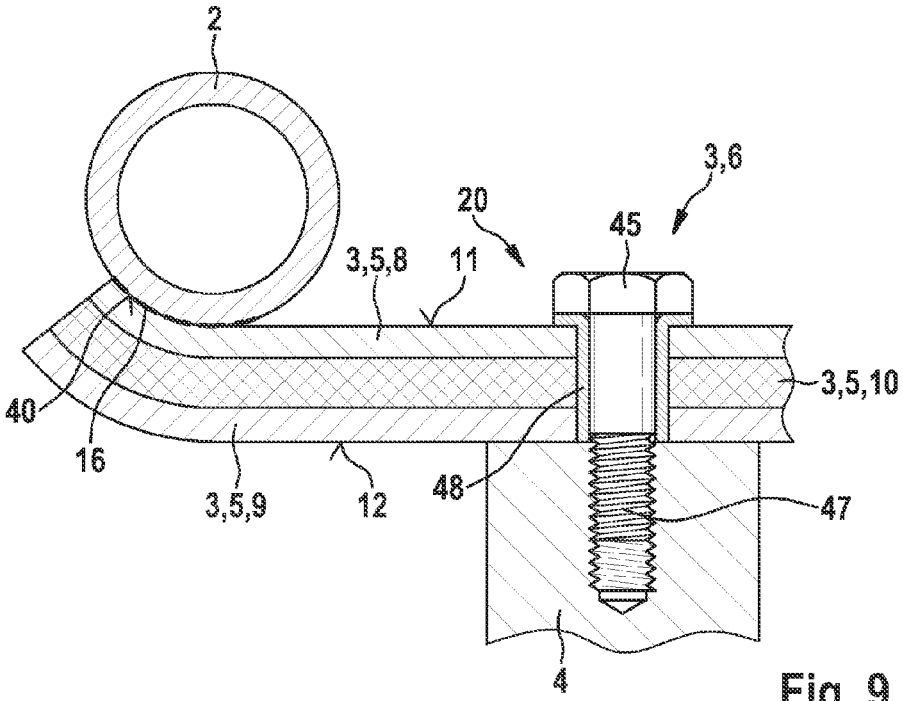
FIG. 9 shows the system shown in FIG. 3, in an excerpted, schematic sectional view, corresponding to a ninth exemplary embodiment of the present invention.

FIG. 9 shows system 1 shown in FIG. 3, in an excerpted, schematic sectional view, corresponding to a ninth exemplary embodiment. In this exemplary embodiment, holder 3 is screwed onto add-on structure 4 with the aid of a fastening means 6, which is embodied as screw 6. A support sleeve 48 is provided, which specifies a defined distance between head 45 and add-on structure 4 during the screw-fitting. In this way a fastening force and thus a prestressing of damping layer 10 are defined as well.

Moreover, layer 9 is resting against add-on structure 4, while layer 10, to which fuel distributor 2 is connected by a welding seam 15, does not contact the add-on structure directly. For layer 8 lies against add-on structure 4 only by way of damping layer 10 and layer 9. Advantageous damping is therefore achieved.

The present invention is not restricted to the exemplary embodiments described.

What is claimed is:

1. A fuel injection system for a high-pressure injection in an internal combustion engine, comprising:

a fuel distributor; and a holder for fastening the fuel distributor to an add-on structure, wherein the holder has a holder body, the holder body having a first layer which is at least essentially made from a metallic material, at least one second layer which is at least essentially made of a metallic material, and at least one elastically deformable damping layer situated between the first layer and the second layer, and wherein the holder body is connected to the fuel distributor by welding.

2. The system as recited in claim 1, wherein the holder body is connected to the fuel distributor by laser welding.

3. The system as recited in claim 1, wherein an outer side of the holder body facing the fuel distributor is provided at the first layer in at least a connection region of the welded connection between the holder body and the fuel distributor, and the first layer of the holder body is connected to the fuel distributor by welding.

4. The system as recited in claim 3, wherein the elastically deformable damping layer and the second layer are omitted in the connection region.

5. The system as recited in claim 3, wherein the first layer of the holder body is configured as an externally situated first layer.

6. The system as recited in claim 5, wherein the holder body has at least one third layer which is at least essentially made of a metallic material and at least one further elastically deformable damping layer, and wherein the second layer of the holder body is configured as an internally situated second layer, and the at least one further elastically deformable damping layer is situated between the internally situated second layer and the third layer.

7. The system as recited in claim 3, wherein the holder body is configured approximately in strip form.

8. The system as recited in claim 3, wherein the fuel distributor is configured as fuel distributor rail, the holder body is connected to the fuel distributor along a longitudinal axis of the fuel distributor, and securing tabs are provided on the holder body, and wherein the holder body is fastened to the add-on structure via the securing tabs.

9. The system as recited in claim 3, wherein at least in a connection region of the welding connection between the holder body and the fuel distributor, the fuel distributor has an outer side which is not planar, and the holder body is premolded on the non-planar outer side of the fuel distributor at least in the connection region.

10. The system as recited in claim 6, wherein the elastically deformable damping layer is made of a visco-elastic material.

* * * * *